US007216404B1

(12) United States Patent
Doyle

(10) Patent No.: US 7,216,404 B1
(45) Date of Patent: May 15, 2007

(54) POUCH MOUNTING SYSTEM

(76) Inventor: Kenneth Doyle, 7 Fontaire, Coto De Caza, CA (US) 92679

( * ) Notice: Subject to any disclaimer, the term of this patent is extended or adjusted under 35 U.S.C. 154(b) by 0 days.

(21) Appl. No.: 11/510,182

(22) Filed: Aug. 24, 2006

Related U.S. Application Data

(60) Provisional application No. 60/767,384, filed on Mar. 23, 2006.

(51) Int. Cl.
*A41F 1/00* (2006.01)

(52) U.S. Cl. ..... 24/573.11; 24/3.5; 24/3.7; 24/104; 24/106; 24/114.12; 24/453; 24/578.1; 24/DIG. 35; 24/DIG. 31; 206/286; 206/317; 383/13; 248/682; 248/689; 224/194; 224/198

(58) Field of Classification Search ..... None
See application file for complete search history.

(56) References Cited

U.S. PATENT DOCUMENTS

| | | | | | |
|---|---|---|---|---|---|
| 312,054 | A | * | 2/1885 | Williams | 24/575.1 |
| 542,158 | A | * | 7/1895 | Grenthal | 2/175.3 |
| 696,626 | A | * | 4/1902 | Cohen | 24/470 |
| 779,478 | A | * | 1/1905 | Hope | 24/90.5 |
| 1,682,771 | A | | 9/1928 | Butler | |
| 2,041,498 | A | * | 5/1936 | Swidersky | 24/459 |
| 2,300,342 | A | * | 10/1942 | Cheney | 24/479 |
| 2,302,341 | A | * | 11/1942 | Nash | 24/479 |
| 3,530,550 | A | * | 9/1970 | White | 24/464 |
| 3,865,290 | A | | 2/1975 | Sperling | |
| 4,308,647 | A | | 1/1982 | Gillis | |
| 4,559,675 | A | | 12/1985 | Devenny | |
| 4,985,968 | A | | 1/1991 | Hooper | |
| 5,067,642 | A | * | 11/1991 | Fodge | 224/192 |
| 5,075,938 | A | * | 12/1991 | Hutchinson | 24/464 |
| 5,168,605 | A | * | 12/1992 | Bartlett | 24/519 |
| 5,557,830 | A | * | 9/1996 | Davis | 24/459 |
| 5,655,271 | A | | 8/1997 | Maxwell-Trumble et al. | |
| 5,926,920 | A | | 7/1999 | Denison | |
| 5,940,942 | A | * | 8/1999 | Fong | 24/459 |
| 6,209,615 | B1 | * | 4/2001 | Whittemore | 160/368.1 |
| 6,223,399 | B1 | | 5/2001 | Chen | |
| 6,718,600 | B1 | * | 4/2004 | Gillis | 24/459 |
| 2003/0014844 | A1 | | 1/2003 | Splane | |

* cited by examiner

*Primary Examiner*—Jack W. Lavinder
(74) *Attorney, Agent, or Firm*—Gene Scott; Patent Law & Venture Group

(57) ABSTRACT

A fastener system mounts a pouch onto a shirt or other clothing article, wherein the pouch provides a receptacle aperture into which a fastener is placed with its flanges positioned on opposing sides of the aperture. The cloth to which the fastener is mounted is gripped between the fastener and the aperture and is locked into place by a U-shaped clip. The flanges are made oblong in shape so that the narrow orientation of the flanges easily pass through the aperture, but the longer orientation cannot. Flats may be applied to both aperture and the fastener so as to assure an orientation in use wherein the fastener cannot disengage from the pouch.

15 Claims, 2 Drawing Sheets

POUCH MOUNTING SYSTEM

CROSS-REFERENCE TO RELATED APPLICATIONS

This application claims priority of a prior filed Provisional Patent Application having Ser. No. 60/767,384 and official filing date of Mar. 23, 2006 and which discloses the same subject matter.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to a system for mounting a pouch to a garment at any selected location and more particularly to a fastener for enabling such a system.

2. Description of Related Art Including Information Disclosed Under 37 CFR 1.97 and 1.98

Splane, Jr., U.S. 2003/0014844, discloses a removable storage device to enable storage of personal articles on the person of a user. The device includes a pair of snap fit elements. One element includes a recess for receiving a portion of the other element as a snap fit therein so as to permit a portion of an article of clothing worn by the user to be captured between the elements when the elements are snap fit together to thereby removably affix the elements to the article of clothing. One of the snap fit elements includes a support member or arrangement (e.g., a D-ring or a pocket) for supporting a personal article.

Butler, U.S. Pat. No. 1,682,771, discloses a separable button, a base, a shank formed on one face of the base and formed with front threads for its entire length, and over which a piece of fabric is adapted to be disposed, a split resilient ring encircling the fabric covered shank at the juncture of the shank with the base, a head provided with a threaded socket in the inner side thereof, and an internally threaded collar formed on the inner side of the head and extending outwardly therefrom around the socket, the fabric covered threaded shank being removable secured in the socket and collar.

Sperling, U.S. Pat. No. 3,865,290, discloses a tennis ball holder is comprised of a lightweight, vacuum-formed, concave plastic shell having a plurality of fingers which grip the ball to retain the ball within the shell. The rear wall of the shell is generally flat and contains a keyhole. In use, the holder is placed with its rear wall against the outside of the player's clothing at a convenient place. Then a flat plate is positioned underneath the clothing opposite the holder. The plate has a key arranged to project into the keyhole along with the fabric and lock there so as to securely anchor the holder and the ball contained therein to the player's clothing, freeing his hands for play.

Gillis, U.S. Pat. No. 4,308,647, discloses a clip is provided which is adapted for fastening onto a flexible web such as a sheet of fabric. The clip is particularly adapted for fastening the fabric of a tent to supporting poles or stakes or for fastening webs together.

Devenny, U.S. Pat. No. 4,559,675, discloses an invention that is a support for fastening a decorative object such as a flower or corsage to an article of clothing comprising a pair of elements having cooperative shapes such that one clamps into the other, from one side thereof. A decorative object is secured to one of the elements. Accordingly, one of the pair of elements can be clamped into the other from opposite sides of the article of clothing, clamping and catching the article of clothing therebetween and securing it thereto.

Hooper, U.S. Pat. No. 4,985,968, discloses a decorative body member that includes a safe and harmless separable, interlocking fastening device for engaging a portion of a garment therebetween. In one embodiment, an elongated ribbon is attached at one end to the body member and at the other to a pacifier, teething ring, or toy, to avoid loss. The fastener includes a circular pattern of fingers or prongs (female element) extending from the rear surface of the body member. The male element is a disk which is received within the fingers with the fabric therebetween. The disk is sufficiently large to prevent swallowing, and preferably includes an aperture through the center thereof to provide for passage of air if the disk should become lodged in the mouth or inadvertently swallowed.

Maxwell-Trumble et al., U.S. Pat. No. 5,655,271, discloses a clothing accessory that includes a molded plastic plate and a molded plastic ring. The periphery of the plate is provided with a first engagement surface and the interior of the ring is provided with a second engagement surface. The relative dimensions of the plate and the ring are chosen such that the fabric of an article of clothing can be engaged between the first and second engagement surfaces. More specifically, when the ring is placed on one side of a fabric and the plate is placed on the other side of a fabric, the plate and ring may be pressed together so that the plate is frictionally engaged inside the ring by the fabric of the clothing. According to a presently preferred embodiment, the engagement surfaces are V-shaped. I.e. one of the surfaces is a concave V-shaped groove and the other is a convex V-shaped edge. Other preferred aspects of the invention include providing a peripheral lip on the plate which extends substantially orthogonal to one side surface of the plate to define an image receiving area. According to the invention, a photograph, hologram or other decorative indicia is attached to the plate by providing the indicia on a material which is attached to the plate with an adhesive. Preferably, the material is a self-adhesive, peel and stick material. A kit according to the invention, includes a plate, a ring, and a plurality of self-adhesive labels, each bearing different decorative indicia.

Denison, U.S. Pat. No. 5,926,920, discloses a snap-in adapter system that includes an interior piece having a circular interior face and a short cylindrical side wall forming a cylindrical recess, the recess having an interior diameter. The system also includes an exterior piece. The exterior piece has a circular exterior face with a diameter essentially equal to that of the diameter of the recess of the interior piece. The exterior piece also has a cylindrical projection. Also provided is an attachment means.

Fong, U.S. Pat. No. 5,940,942, discloses a fabric holder to secure a plurality of fabrics together. The apparatus comprises two pieces, a male bottom piece and a female top piece which interlock to secure the fabric.

Chen, U.S. Pat. No. 6,223,399, discloses an adornment clamping device which is able to secure the adornment to the base of an item. The device has an elongate bar securely connected with the base by means of a neck, an adornment having a through hole defined to allow the elongate bar to be inserted there through and having a press fit therewith and a slit defined to communicate with the through hole, such that when the elongate bar extends through the through hole of the adornment, the adornment is able to be secured by the press fit between the protrusion formed on the neck and the slit.

The related art described above discloses numerous two-part fastener for wedging a cloth garment therebetween for mounting an item on the garment. However, the prior art fails to disclose an integral fastener with two flanges that is mountable in an aperture of the item to be mounted and which secures the item on the garment. As well, the prior art fails to teach a locking element that is engaged with the fastener after it is mounted. Finally, the prior art fails to teach the use of an elongated flange that may be preferably biased in a position where it is impossible to disengage from the item being attached to the garment. For these reasons, the present disclosure distinguishes over the prior art providing heretofore unknown advantages as further described in the following summary and detailed description and illustrated in the attached drawing sheets.

BRIEF SUMMARY OF THE INVENTION

This disclosure teaches certain benefits in construction and use which give rise to the objectives described below.

A fastener system mounts a pouch onto a shirt or other clothing article, wherein the pouch provides a receptacle aperture into which a fastener is placed with its flanges positioned on opposing sides of the aperture. The cloth to which the fastener is mounted is gripped between the fastener and the aperture and is locked into place by a U-shaped clip. The flanges are made oblong in shape so that the narrow orientation of the flanges easily pass through the aperture, but the longer orientation cannot. Flats may be applied to both aperture and the fastener so as to assure an orientation in use wherein the fastener cannot disengage from the pouch.

A primary objective inherent in the above described apparatus and method of use is to provide advantages not taught by the prior art.

Another objective is to provide a means for mounting a pack or pouch onto a shirt or other article of clothing.

A further objective is to provide such a mounting means that may be placed at random.

A still further objective is to provide such a mounting means with a security locking device to assure that the mount cannot loose its hold.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Described now in detail is a fastener system for randomly mounting a pouch 10 on a fabric article 20 such as a garment, where the fabric article 20 need have no means for receiving the pouch such as a button hole, a clip, a clasp or a pin. The pouch 10 has a sheet portion 12 extensive to and preferably integral with a portion for receiving at least one article so as to fulfill the purpose of the present apparatus; to carry articles on ones person at a selected body location without the need for additional attachment hardware other than a fastener 30 designed for the purpose.

Figure 3:
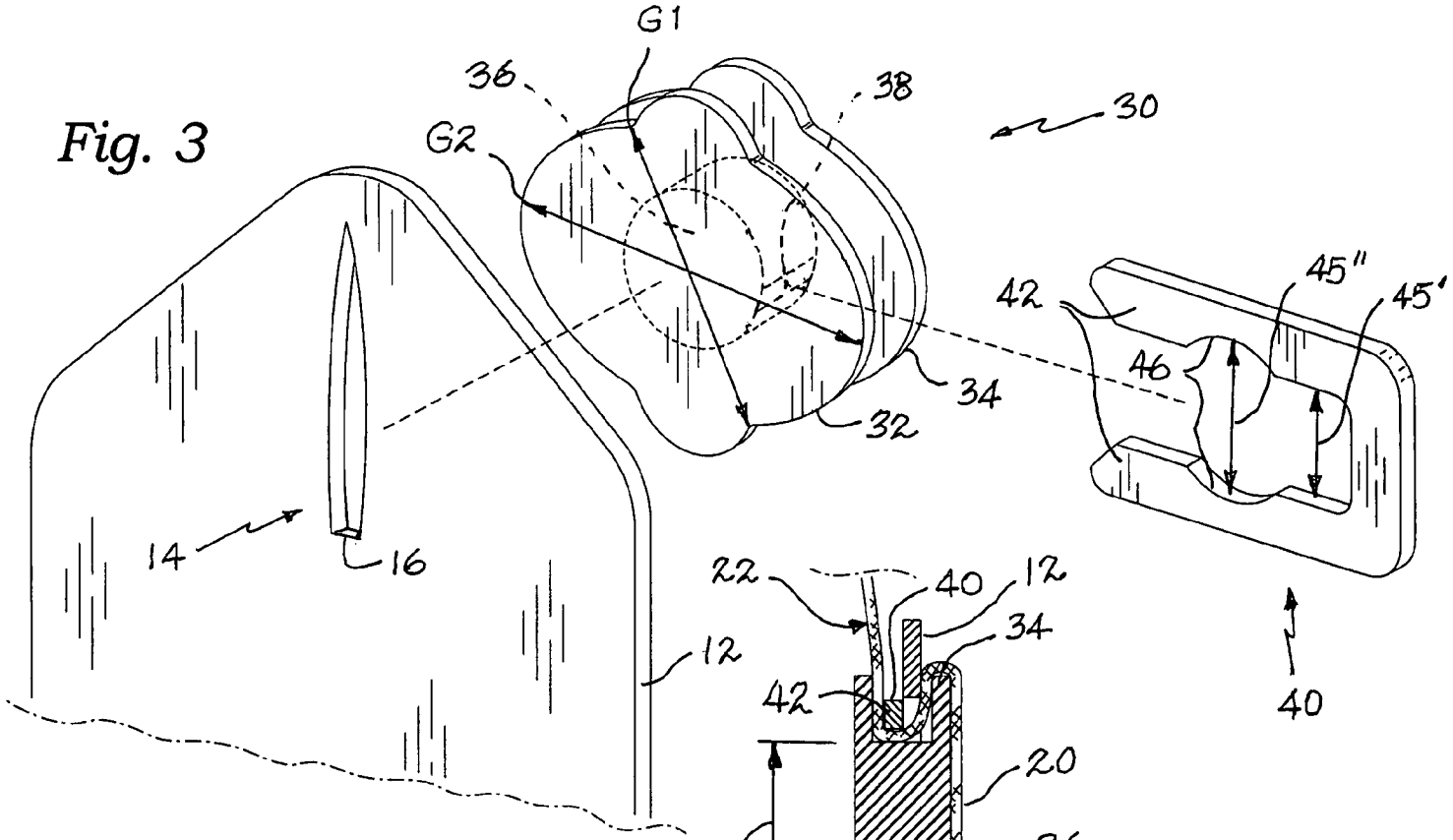
FIG. 3 is an exploded view of the several items thereof.
Figure 4:
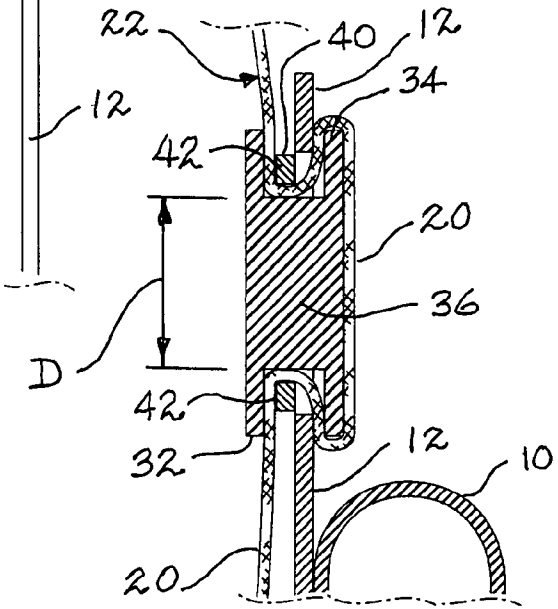
FIG. 4 is a partial cross sectional view thereof taken along line 4-4 in FIG. 2.

The sheet portion 12 provides a receptacle aperture 14 as best shown in FIG. 3 preferably an elongated slit as illustrated. The fastener 30 is constructed of plastic preferably, and has a pair of flanges 32 and 34 which are held in spaced apart positions by an integral connector 36. The connector 36 has a connector diameter "D." As shown in FIG. 4, the connector 36 is inserted into the receptacle aperture 14 from one side 22 of the fabric article 20 thereby positioning the pair of spaced apart flanges 32, 34 on opposing sides of the sheet portion 12 of the pouch 10 and engaging the fabric article 20 between the sheet portion 12 and the fastener 30. The flanges 32, 34 are extensive relative to the receptacle aperture 14 for capturing the fastener 30 and the fabric article 20 within the sheet portion 12. Clearly, with the sheet portion 12 of fabric article 20 engaged as shown in FIG. 4, the pouch 10 is not able to move relative to the fabric article 20.

To insure a more positive lock between pouch 10 and fabric article 20, a U-shaped clip 40 is engaged between the pair of flanges 32, 34 as shown in FIG. 4. Preferably, the U-shaped clip 40 is of a resilient material formed with opposing legs 42 separated by a first distance 45', the legs 42 mutually joined at one end 44 of each of the legs 42. Preferably, the opposing legs 42 provide mutually facing detent surfaces 46, the detent surfaces separated by a second distance 45", the second distance exceeding the first distance 45' and is approximately equal to the connector diameter "D".

Preferably, the flanges 32, 34 are oblong in shape having a smaller girth G1 in a first orientation and a larger girth G2 in a second orientation as shown in FIG. 3, the receptacle aperture 14 is preferably elongate in shape and sized for receiving the smaller girth G1, but not the larger girth G2. Preferably, the aperture 14 has a flat 16 at one end thereof and the connector 36 has a corresponding flat 38, although in stead of a flat, the connector 36 may be formed with an oval shape. After insertion of the flange 34 into the aperture 14 and then rotating the fastener 30 so that the flats 16 and 38 abut, or a longer side of the overall shape abuts the flat 16, the larger girth G2 is aligned with the elongate shape of the aperture 14 so that the flanges 32 and 34 are not able to disengage with the elongate slot 14 and the weight of the pouch (pressing downward by its weight) prevents the from rotating away from the abutting relationship until manually and purposefully rotated after relieving the weight biasing.

The fabric article 20 clearly may be almost any article of clothing or similar articles such as shirts, a jackets and a pairs of pants, but can also be any relatively flexible fabric such as a curtain, a blanket, and so on, while the pouch 10 may be any item that one wishes to carry on their person or otherwise without the use of fasteners such as pins and clips. Typical articles include money holders, a firearm holsters, and utility bags. The item however, must have a sheet portion 12 that is able to be married with the fastener 30 using the aperture 14.

Figure 1:
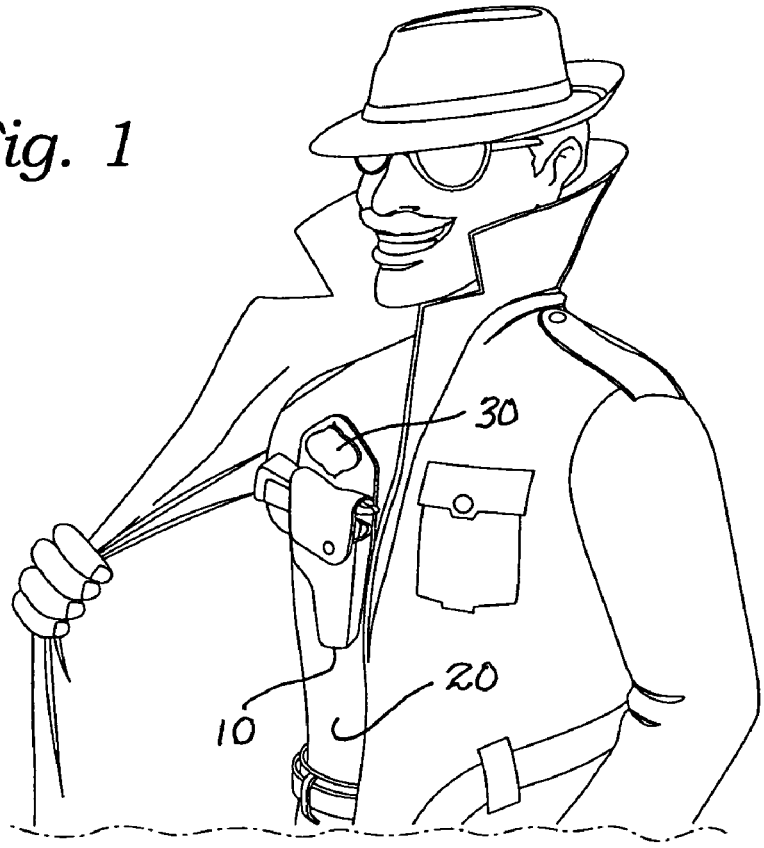
FIG. 1 is a perspective view of the presently described apparatus in use on a person.
Figure 2:
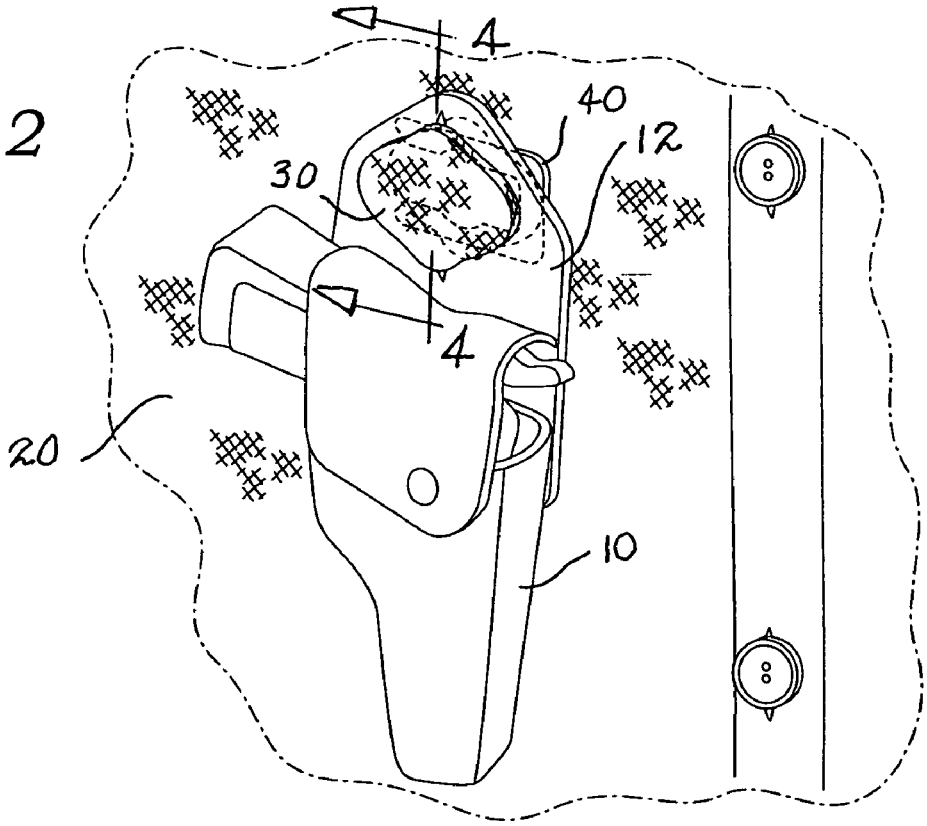
FIG. 2 is a partial close-up view thereof.

The method of the present invention, i.e., the method of use includes the steps of abutting the first flange 32 of a fastener 30 against a portion of a fabric article 20 and then pressing the first flange 32 and the portion of the fabric article 20 through the aperture 14 in the sheet portion 12 of the pouch 10 so that the first flange 32 is positioned on one side of the sheet portion 12, while the second flange 34 is positioned on the opposing side as shown in FIG. 4 and so that a portion of the fabric article 20 extends through the aperture 14. Next, the U-shaped clip 40 is slid between the first and second flanges 32 and 34 thereby positioning detent surfaces 46 against the connector 36, so as to lock the fastener 30 within the aperture 14, and in this way the pouch 10 is mounted onto the fabric article 20 as shown in FIGS. 1 and 2. The flanges 32, 34 when formed as oblong in shape as described above, and when the flat 16 at one end of the aperture 16 and at the flat 38 at one position on the connector 36 abut, the larger girth G2 is aligned with the length of the aperture 14 thereby preventing the fastener 30 from disengaging with the sheet portion 12 of pouch 10.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A fastener system for mounting to a fabric article, the system comprising: a pouch having a sheet portion thereof, the sheet portion providing a receptacle aperture therein; and a unitary fastener, the fastener having a pair of flanges held in spaced apart positions by a connector, the flanges and connector being formed as an integral and inseparable part, the connector having a connector diameter; the connector positionable within the receptacle aperture thereby positioning the pair of spaced apart flanges on opposing sides of the sheet portion of the pouch; the flanges extensive relative to the receptacle aperture for capturing the fastener within the sheet portion; and a U-shaped clip engagable between the pair of flanges for locking the fastener in the sheet portion.

2. The system of claim 1 wherein the flanges are oblong in shape having a smaller girth in a first orientation and a larger girth in a second orientation, the receptacle aperture elongate in shape and sized for receiving the smaller girth but not the larger girth.

3. The system of claim 2 wherein the aperture has a flat at one end thereof and the connector has a corresponding flat, the flats when abutting position the larger girth of the flanges in alignment with the elongate shape of the aperture.

4. The system of claim 1 wherein the U-shaped clip is of a resilient material formed with opposing legs separated by a first distance, the legs mutually joined at one end of each of the legs.

5. The system of claim 4 wherein each of the opposing legs provide mutually facing detent surfaces, the detent surfaces separated by a second distance, the second distance exceeding the first distance, the second distance being approximately equal to the connector diameter.

6. A fastener system comprising: a fabric article; a pouch having a sheet portion thereof, the sheet portion providing a receptacle aperture therein; and a fastener, the fastener having a pair of flanges held in spaced apart positions by an integral connector, the connector having a connector diameter; the connector positionable within the receptacle aperture from one side of the fabric article thereby positioning the pair of spaced apart flanges on opposing sides of the sheet portion of the pouch and engaging the fabric article between the sheet portion of the pouch and the fastener; the flanges extensive relative to the receptacle aperture for capturing the fastener and the fabric article within the sheet portion; wherein the flanges are oblong in shape having a smaller girth in a first orientation and a larger girth in a second orientation, the receptacle aperture elongate in shape and sized for receiving the smaller girth but not the larger girth.

7. The system of claim 6 further comprising a U-shaped clip engagable between the pair of flanges.

8. The system of claim 7 wherein the U-shaped clip is of a resilient material formed with opposing legs separated by a first distance, the legs mutually joined at one end of each of the legs.

9. The system of claim 8 wherein each of the opposing legs provide mutually facing detent surfaces, the detent surfaces separated by a second distance, the second distance exceeding the first distance, the second distance being approximately equal to the connector diameter.

10. The system of claim 6 wherein the aperture has a flat at one end thereof and the connector has a corresponding flat, the flats when abutting position the larger girth of the flanges in alignment with the elongate shape of the aperture.

11. The system of claim 6 wherein the fabric article is one of: a shirt, a jacket and a pair of pants.

12. The system of claim 6 wherein the pouch is one of: a money holder, a firearm holster, and a utility bag.

13. A fastening method comprises the step of:

a) abutting a first flange of a fastener against a portion of a fabric article;

b) pressing the first flange and the portion of the fabric article through an aperture in a sheet portion of a pouch so that the first flange is positioned on one side of the sheet portion, while a second flange of the fastener remains on the opposing side of the sheet portion, the portion of the fabric article extending through the aperture; and c) sliding a U-shaped clip between the first and second flanges thereby positioning detent surfaces thereof against a connector, the connector joining the first and second flanges, so as to lock the fastener within the aperture.

14. The fastening method of claim 13 further comprising the steps of forming the flanges as oblong in shape thereby establishing a smaller girth in a first orientation and a larger girth in a second orientation and forming the receptacle aperture as elongate in shape and sized for receiving the smaller girth but not the larger girth.

15. The fastening method of claim 14 further comprising the steps of forming a flat at one end of the aperture and at one position of the connector; passing the first flange through the aperture by aligning the smaller girth with the aperture and then rotating the connector to abut the flats of the aperture and the connector so as to align the larger girth with the length of the aperture.

* * * * *